US006102407A

United States Patent [19]

Moriya et al.

[11] Patent Number: 6,102,407

[45] Date of Patent: Aug. 15, 2000

[54] JOINT SEAL AND ASSEMBLY METHOD THEREOF

[75] Inventors: Mamoru Moriya; Kenichi Hasegawa, both of Tokyo, Japan

[73] Assignee: Seiki Kogyo Co., Ltd., Tokyo, Japan

[21] Appl. No.: 09/013,065

[22] Filed: Jan. 26, 1998

[30] Foreign Application Priority Data

Feb. 20, 1997 [JP] Japan ..... 9-052387
Mar. 18, 1997 [JP] Japan ..... 9-084357

[51] Int. Cl.[7] ..... F16J 15/02; E04B 1/68; C09K 3/10

[52] U.S. Cl. ..... 277/316; 277/630; 277/645; 277/906; 52/366; 52/396.04; 52/471; 52/741.1; 404/49; 404/69

[58] Field of Search ..... 277/316, 630, 277/645, 637, 650, 542, 906, 935; 404/47, 49, 69; 52/312, 741.4, 393, 396.04–396.08, 366, 374, 471, 514.5

[56] References Cited

U.S. PATENT DOCUMENTS 892,377 6/1908 Kieserling .
3,572,735 3/1971 Dryer ..... 277/637

FOREIGN PATENT DOCUMENTS 1262550 6/1968 Germany ..... 52/396.07
402115434 4/1990 Japan ..... 52/741.4

*Primary Examiner*—Robert Canfield
*Attorney, Agent, or Firm*—Oblon, Spivak, McClelland, Maier & Neustadt, P.C.

[57] ABSTRACT

A joint seal is designed to maintain its proper position in the joint groove opening port to create an effective seal between the inner walls of the joint groove and to resist peeling or damage, even in an event, such as an earthquake, during which the adjacent outer wall materials shift; and to have a joint base material 2, a sealing material 3 and a heart wood 8. The joint base material 2 has at least two seal tongue pieces 14*a* and 14*b* projecting from the outer face of side plates 5, 5. A number of small openings 8 to allow sealing material to be pressed out at the insertion of heart wood 8 is punched between the seal tongue pieces 14*a* and 14*b*, and release mold sheets 18*a* and 18*b* are attached to joint base material 2 as a cap member covering the small openings 8 and the opening ports of side plates 5, 5.

18 Claims, 9 Drawing Sheets

JOINT SEAL AND ASSEMBLY METHOD THEREOF

TECHNICAL FIELD OF THE INVENTION

The present invention relates to a joint seal for a joint finish that is fitted in a joint groove opening port, as found in a joint section of a wall face exterior material of a building, and a method for assembling the joint seal.

DESCRIPTION OF THE PRIOR ART

It is well known that the joint seal disclosed in Japanese Patent Application No. 132104, 1994 is designed to permit a sealing material to flow from an opening port for heart wood insertion at the upper part of a joint base to both sides of the foregoing heart wood by engaging a joint seal filled with the sealing material in the joint groove opening port when the heart wood is pressed into the joint base.

However, since the foregoing suggested joint seal is designed to adhere to and secure the base plate of the joint base directly to the bottom face of the joint groove, the arrangement encounters problems if the joint groove happens to be deep, with the sealing material tending to flow out when the heart wood is pressed into the space surrounded by the seal tongue piece at the upper part of the joint base material, the heart wood and the inner wall of the joint groove. Therefore, in some cases the sealing material is not contained in that small space when the width of the joint groove is narrow and does not properly fit to the joint groove with various width. The result may be that the sealing material is forced out of the heart wood.

In addition, the foregoing joint seal is fixed not only to the bottom face of the joint groove but to both side walls by the sealing material, and the resulting adjacent three faces are fixed to the inside of the joint groove. This arrangement permits almost no freedom for relative displacement of the adjacent external wall material In an earthquake or other event that causes the wall materials to shift, the sealing material may be removed from the joint groove or parts of the joint broken.

SUMMARY OF THE INVENTION

The technical issue addressed by the present invention is to provide a joint seal and a assembly method in which the joint seal can be placed in the joint groove opening port in proper position, regardless of the depth or width of the joint groove; in which space is provided for surplus sealing material, whereby the sealing material is not forced out of the joint exterior when the heart wood is inserted, in order to provide an effective seal at the inner surfaces of the joint groove.

Another technical problem addressed by this invention is to devise a method for building a joint seal that provides a degree of freedom for the relative displacement of external wall materials, in order to prevent the sealant from being removed from the joint, even in the event of an event such as an earthquake that might shift the external wall.

Yet another technical issue addressed by this present invention is the creation of a joint seal by preventing excessive insertion of the joint base material into the joint by ensuring proper depth, and to enable the exterior plate on the outer surface of the joint to be set so that its surface is uniform, without recesses and projections.

To solve the problems thus described, the first joint seal of the present invention has a joint base molded roughly in the shape of a U by means of left, right and bottom plates made of synthetic resin, a sealing material which has flow properties and viscosity is forced between both side plates in the joint base material, and heart wood to be inserted into the base between the side plates, characterized in that:

the foregoing joint base material is provided with at least two soft seal tongue pieces through frictional contact with the inner wall of the joint groove that project on the outer face of the left and right side plates, and a number of small openings for pressing out the sealing material together with insertion of the foregoing heart wood, punched between these seal tongue pieces in both side plates;

the foregoing heart wood at its head is an exterior plate made of weatherproof resin covering the joint groove opening port;

the foregoing sealing material is supplied in sufficient quantity for secure sealing by being pressed out and occupying the space surrounded by a pair of seal tongue pieces and the inner wall of the joint groove;

between the seal tongue piece on the opening port side of the joint groove in the foregoing joint base material and the head of the heart wood inserted between both side plates of the joint base material, the sealing material residue is forced into the foregoing space in insertion of the heart wood between the side plates to form a flow-in space by pushing and widening the seal tongue pieces on the opening port side of the joint groove; and a sealing member for preventing leakage of the sealing material is attached to the foregoing joint base material b, covering the foregoing small opening and the opening port between both side plates.

In addition, the second joint seal of the present invention at the outer ends of the left and right side plates is provided with an engaging lock collar for engaging and locking the foregoing joint base material with the opening edge of the joint groove, and is characterized in that:

at least two soft seal tongue pieces for sealing between the inner walls of the joint groove project on the outer faces of both side plates, and a number of small openings for pressing out the sealing material together with insertion of the foregoing heart wood is punched between these seal tongue pieces in both side plates;

the foregoing joint seal is provided with the sealing member attached to a number of small openings punched between the seal tongue pieces of both side plates in the joint base material that can be employed as a release mold sheet to adhere to that portion; and the sealing member covering the opening port between both side plates is inserted into the opening port, helping to keep this opening from narrowing and thereby forming a cap body for holding the shape of the joint base material;

alternatively, the sealing member to be attached to a number of small openings punched between the seal tongue pieces of both side plates in the joint base material is employed as a release mold sheet to adhere to that portion;

and the sealing member covering the opening port between both side plates can be employed as a release mold sheet to adhere to the outer face of the opening port.

In addition, the parts for engaging heart wood with heart wood when the heart wood is inserted between both side plates of the joint base material, can be formed on the inside face of both side plates in the foregoing joint base material and both side faces of the heart wood. Further, the foregoing cap body can also be provided with an engagement portion that engages with the engagement portion formed on the inside face of both side plates in the foregoing joint base material.

For the foregoing joint seal, it is preferable in sealing the joint groove that the sealing material be linked between the tip of the core of the foregoing heart wood and the bottom plate of the joint base material or between the tip of the foregoing cap body and the bottom plate of the joint base material in order to obtain a durable seal.

On the other hand, the assembly method of the foregoing first joint seal of the present invention has:

a process of pressing into the joint groove the joint base material of which the release mold sheet on the outer face of the side plate is peeled off, and holding the joint base in the joint groove opening with friction between a pair of seal tongue pieces on the outer face of the side plate and the inner wall of the joint groove; and a process of inserting the heart wood between the left and right side plates of the joint base material engaged in the joint groove, or inserting the heart wood while pressing the cap body inserted into the opening port between the side plate, pressing out the sealing material charged between both side plates from the small openings punched in the side plates into a space surrounded by a pair of seal tongue pieces, pushing and widening the seal tongue pieces on the opening port side of the joint groove in the joint base material by pressure of the sealing material itself when there is a residue of sealing material pressed out to that space, and flowing-in the residue between the seal tongue piece and the head of the heart wood.

In addition, the assembly method of the foregoing second joint seal of the present invention has:

a process of pressing in the joint groove the joint base material of which the release mold sheet on the outer face of the side plate is peeled off, pressure-welding in the joint groove opening port a pair of seal tongue pieces on the outer face of the side plate, and engaging and locking the locking collar portion provided on the side plate with the opening edge of the joint groove; and a process of pressing in the heart wood while pressing the cap body inserted into the opening port between the side plates, pressing out the sealing material forced between both side plates from the small openings punched on the side plates into a space surrounded by a pair of seal tongue pieces and the inner wall of the joint groove, pushing and widening the seal tongue pieces on the opening port side of the joint groove in the joint base material by the pressure of the sealing material itself when there is a residue of the sealing material pressed out to that space, and flowing-in the residue between the seal tongue pieces and the head of the heart wood.

Further, in the assembly method of the present invention, while the foregoing joint base material is pressed in the joint groove, a stopper for setting the insertion depth of the joint base material is engaged and held in the joint groove. Thereafter, the joint base material can be pressed in the joint groove at the limit of a position at which the base plate of the foregoing joint base material abuts the stopper.

In the foregoing joint seal and the assembly method thereof, when the joint base material is engaged in the opening port of the joint groove, in the foregoing first joint seal the seal tongue pieces projecting from the outer face of both side plates in the joint base material come into frictional contact with the inner wall of the joint groove. Therefore, the pieces can be positioned by means of that friction without regard to the depth of the joint groove, and the position of the joint base material can be held in the joint groove opening port.

In addition, in the second joint seal provided with a locking collar portion at the outer end parts of both side plates in the joint base material, the positioning of the joint base material and securing that position can be ensured by engaging and locking the locking collar portion with the opening edge of the joint groove.

If the frictional contact of the seal tongue pieces against the inner wall of the joint groove is insufficient upon the assembly of the foregoing first joint seal or if the engaging lock collar portion is prevented from engaging with the opening edge of the joint groove by an irregularity at the opening edge of the joint groove upon the assembly of the second joint seal, a stopper is first engaged and held discretely in the joint groove and the engaged-in depth of the joint base material can be set by means of this stopper.

Thus, even if friction between the seal tongue piece projecting from the outer face of the side plate and the inner face of the joint groove or the engaging and locking of the engagement collar portion against the opening edge of the joint groove is incomplete, the insertion limit is set by the foregoing stopper, and the joint base material is nerver pushed too far into the joint groove.

As described above, if the joint base material is engaged in the joint groove opening port, the seal tongue pieces projecting from the outer face of the seal tongue pieces of both side plates are pressure-welded on the inner wall of the joint groove. However, the sealing material is conversely pressed out by the narrowing of the side plate intervals to be subject to the resistance force from the inside groove of the joint groove. Such a problem can be solved by increasing the strength of the bottom plate of the joint base material; the cap body is inserted into the opening port between both side plates in the foregoing joint base material, or the joint base material is pushed into the joint groove with the tip of the core of the heart wood slightly inserted between side plates, whereby the foregoing both side plates are pushed inward, and the opening port of both side plates can be prevented from narrowing.

Next, when the heart wood is inserted between both side plates of the joint base material, the seal tongue pieces are pushed and widened. As a result, the joint base material is pressure-welded between both inner walls of the joint groove and the sealing material is pressed out from the punched small openings to the side plate of the joint base material together with insertion of the heart wood. However, since the sealing material is forced into a space surrounded by a pair of seal tongue pieces and the inner wall of the joint groove, and the residual sealing material pushes and widens the seal tongue pieces on the opening port side of the joint groove and flows into a space between the head of the heart wood and the seal tongue pieces, the sealing material is never forced outside the joint seal regardless of the width of the joint groove.

Since the foregoing seal tongue pieces come into close contact with the inner wall of the joint groove on its inner face side, with its bent on the opening port side when the joint base material is inserted, even if the sealing material temporarily pressed out is not contained between a pair of seal tongue pieces, the sealing material flows out from between the top seal tongue piece and the inner wall of the joint groove to the opening port side and never flows out from between the seal tongue pieces on the inside of the joint groove, which is difficult to widen due to bending to the inward side, the sealing material is effective in sealing the joint groove regardless of the width of the joint groove.

In addition, engagement portions are formed on the inner faces of both side plates and both side faces of the heart wood in the foregoing joint base material, and the heart wood engages with these engagement portions when the heart wood is pressed into the joint base material, whereby the heart wood is secured from slipping out of the joint base material.

The head of the foregoing heart wood is employed as an exterior plate that covers the joint groove opening port, so that the joins portion is easily hidden and does not detract from the overall appearance.

DESCRIPTION OF EMBODIMENTS

Preferred embodiments of the present invention are described in detail below with references to the drawings. FIG. 1 to FIG. 4 show the first embodiment of the joint seal of the present invention.

Figure 1:
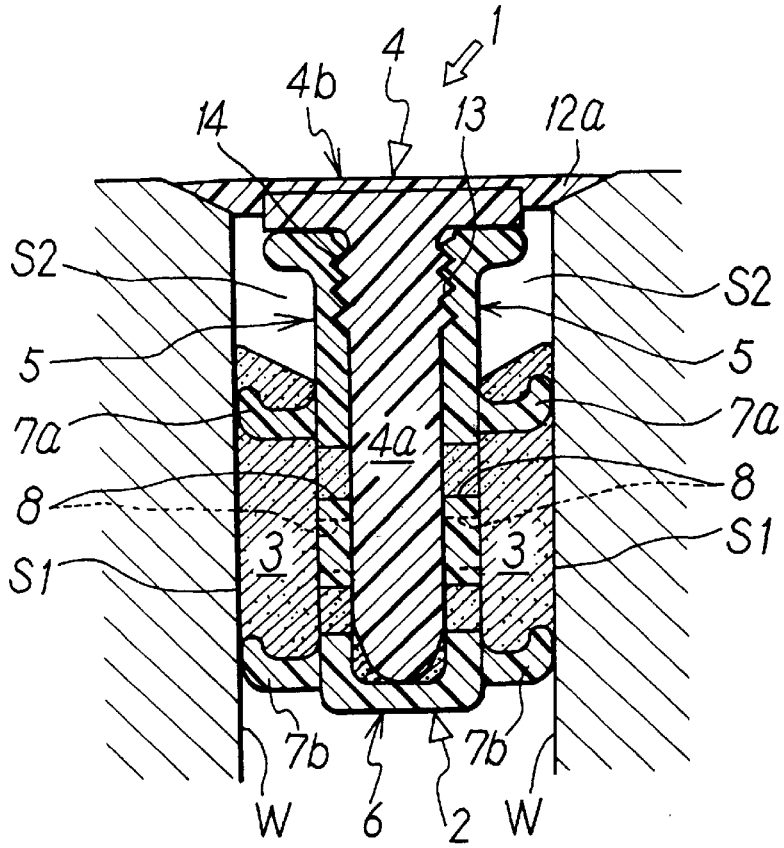
FIG. 1 is a sectional view illustrating the state after assembly of the joint seal of the first embodiment of the present invention.

This joint seal 1 is generally composed of a joint base material 2, a sealing material 3, and a heart wood 4, as seen from FIG. 1. Joint base material 2 and the heart wood 4 are of the sectional shapes described below and are provided in a long shape to facilitate easy assembly.

Figure 2:
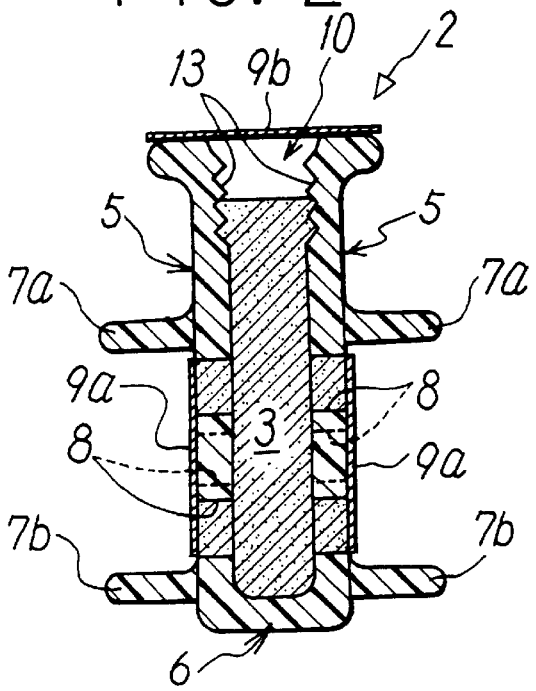
FIG. 2 is a sectional view illustrating the state in which the joint base material of the same embodiment is filled with a sealing material.
Figure 3:
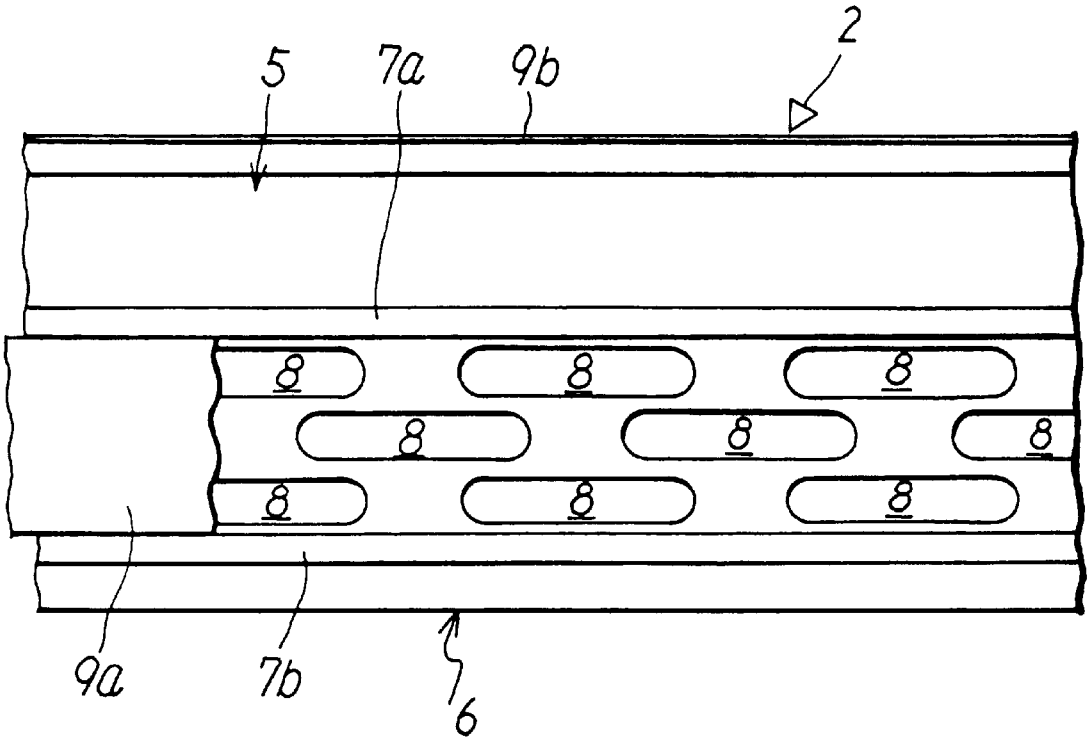
FIG. 3 is a side view of the same portion as above. 15

The foregoing joint base material 2 is molded into the sectional rough U shape while left and right side plates 5, 5 made of hard synthetic resin are coupled with corresponding integral base plate 6, as shown in FIGS. 2 and 3, and a pair of seal tongue pieces 7*a* and 7*b* made of soft synthetic resin is integrated with the project at the upper part and lower part of the side plates 5. Bottom plate 6 can be formed integrally with side plate 5 with soft synthetic resin, as required.

Sealing material 3 which has flow properties and viscosity is forced between foregoing side plates 5, S. Between the foregoing seal tongue pieces 7*a* and 7*b*, in both side plates, a number of small openings 8 for pressing out sealing material 3 in a space S1 surrounded by a pair of seal tongue pieces 7*a* and 7*b* and a inner wall W of the joint groove is punched equally in the longitudinal direction of joint base material 2 and in a number of arrays, as the heart wood 4 is inserted between foregoing side plates 5, 5. In these arrays of small openings 8, the respective small openings 8 are positioned in the middle of the adjacent two small openings 8 in the longitudinal direction of joint base material 2 in adjacent arrays, and are allocated with slightly overlapping the small openings 8 of the adjacent arrays. Thus, sealing material 3 is pressed out roughly equally in the longitudinal direction of joint base material 2.

A sufficient amount of the foregoing sealing material 3 for the case in which the width of the joint groove is relatively wide, that is, a sufficient amount for sealing the material 3 is pressed out and forced into space S1, surrounded by a pair of seal tongue pieces 7*a* and 7*b* and inner wall W of the joint groove between both side plates 5, 5 in the foregoing joint base material 2. Sealing material 3 is made of butyl rubber, rubber based material such as silicon resin or a synthetic resin based elastomer, and needs to have flow properties and viscosity suitable to being pressed out from the small opening 8 of side plate 5 when the foregoing heart wood 4 is pressed between both side plates 5, 5 in the joint base material 2.

To the joint base material 2 into which the sealing material 3 is to be forced, a release mold sheet 9a covering the small opening 8 of both side plates 5, 5 is attached in advance, and a release mold sheet 9*b* covering an opening port 10 between both side plates 5, 5 opening at the upper part of the joint base material 2 is attached after injecting sealing material 3. Release mold sheet 9b can be partially pushed to a position through contact with sealing material 3 between both side plates 5, 5.

Figure 4:
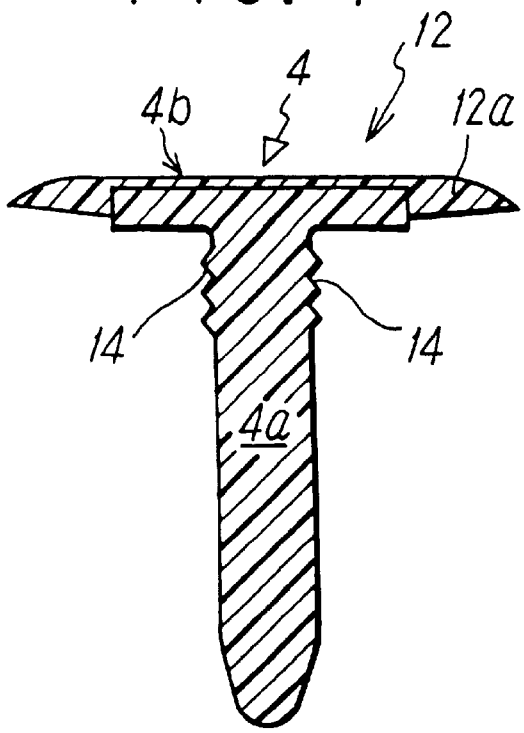
FIG. 4 is a sectional view of a heart wood in the joint seal of the first embodiment.

The foregoing heart wood 4 is molded in a roughly sectional T-letter shape of relatively hard synthetic resin, as shown in FIG. 4. A core portion 4a thereof is molded in the plate shape of a thickness roughly equal to the width between both side plates 5, 5 in the foregoing joint base material 2, the tip part thereof is formed to be round to facilitate insertion of the heart wood between side plates 5, 5 and distribution of the sealing material, and the tip part is formed so that a certain length just reaches bottom plate 6 of joint base material 2.

In addition, a head part 4*b* of the heart wood 4 is employed as an exterior plate 12 to hide the joint section by covering the joint groove opening port, and the exterior plate 12 is molded by integrally attaching a top layer body 12*a* made of weather proof soft synthetic resin.

In this first embodiment, the top layer body 12*a*, made of soft weather proof synthetic resin, is integrally molded, with the top part 4*b* of the heart wood 4 itself employed as exterior plate 12. However, a sheet-shaped weather proof exterior plate may be additionally attached to the head part.

Engagement portions 13 and 14, made of a number of recesses and projections meant to engage with each other when the heart wood 4 is pressed in both side plates 5, 5 of the joint base material 2, are formed, respectively, at the opening edge of the inner face of both side plates 5, 5 in the foregoing joint base material 2 and at the base of both side faces of core portion 4*a* in the foregoing heart wood 4.

When the joint seal of the first embodiment having the foregoing configuration is constructed, the release mold sheet 9*a* attached to the outer face of both side plates 5, 5 in the joint base material 2 is first peeled off, after which joint base material 2 is engaged in that opening port along the joint groove. At this time, since the seal tongue pieces 7*a* and 7*b* projecting from the outer face of both side plates 5, 5 in the joint base material 2 come into frictional contact with inner wall W of the joint groove, positioning at that joint groove opening port is easy regardless of the depth of the joint groove, and the position of the joint base material can be properly maintained in the joint groove opening port by a pair of seal tongue pieces 7*a* and 7*b*. To stabilize the insertion position of joint base material 2, a stopper for setting the; engaging depth of the joint base material as described later (refer to FIGS. 12 and 14) can be discretely engaged and arranged in the joint groove.

In addition, when joint base material 2 is pushed in the joint groove, the seal tongue pieces 7*a* and 7*b* of both side plates 5, 5 are pressure-welded to the inner wall of the joint groove and are subject to the force produced in the direction in which an interval between both side plates 5, 5 is narrowed by that resistance force. Excessive deformation can be prevented by having a sufficiently strong U-letter shaped curve portion that includes the bottom plate 6 below joint base material 2.

Release mold sheet 9*b* covering opening port 10 of the foregoing joint base material 2 may be removed with the foregoing release mold sheet 9a before joint base material 2 is pushed into the joint groove. Removal is not necessary, however.

When the foregoing heart wood 4 is pressed between both side plates 5, 5 of the joint base material 2, seal tongue pieces 7*a* and 7*b* are pushed and widened, with the result that joint base material 2 is rigidly engaged between both inner walls W, W of the joint groove. Sealing material 3 is pressed out from a number of small openings 8, 8 . . . punched on both side plates 5, 5 of the joint base material 2, together with the insertion of the heart wood. Sealing material 3 is forced into space S1, surrounded by at least one pair of seal tongue pieces 7*a* and 7*b* and the inner wall W of the joint groove, securing a proper seal. The residual sealing material 3 pushes and widens the top seal tongue piece 7*a* by means of its own pressure and flows into space S2 between the top part 4*b* of heart wood 4 and the top seal tongue piece 7*a*. Thus, sealing material 3 never overflows to the outside of joint seal 1 regardless of the width of the joint groove.

That is, when joint base material 2 is inserted, the foregoing seal tongue pieces 7*a*, 7*b* come into close contact with inner wall W of the joint groove on its lower face side and is bent up. Thus, even if the temporarily pressed out sealing material 3 is not contained between a pair of the seal tongue pieces 7*a* and 7*b* that sealing material 3 flows up from between the top seal tongue piece 7*a* which is easily bent and the inner wall W of the joint groove and never flows down from between bottom seal tongue piece 7*b*, which is hardly pushed and widened by bending, and sealing material 3 can be used efficiently for sealing the joint groove and is sufficient to fill it regardless of the width of the joint groove.

Since engagement portions 13 and 14 are formed, respectively, on the inner face of both side plates 5, 5 in the foregoing joint base material 2 and on both side faces of the heart wood 4, the heart wood 4 can be secured from slipping off from the joint base material 2 by mutually engaging it with these engagement portions 13 and 14 when heart wood 4 is pressed into the joint base material 2.

Since the top part 4*b* of the foregoing heart wood 4 is used as the exterior plate 12 covering the joint groove opening, the joint section can be easily hidden without detracting from overall appearance, by the assembly of the joint seal 1. And since exterior plate 12 is molded from weather proof synthetic resin, sealing material 3 can be prevented from deterioration from exposure to ultraviolet radiation or other natural factors.

After assembly of the joint seal 1, since the foregoing sealing material 3 is sealed in the joint groove by means of seal tongue pieces 7*a* and 7*b* of joint base material 2 and exterior plate 12 of head part 4*b* of the heart wood 4, the foregoing sealing material 3 is never exposed directly to solar ultraviolet radiation or the like. Therefore, a reduction in sealing effectiveness due to deterioration of sealing material 3 can be avoided, and a longer service life of the joint seal 1 can be ensured.

Figure 5:
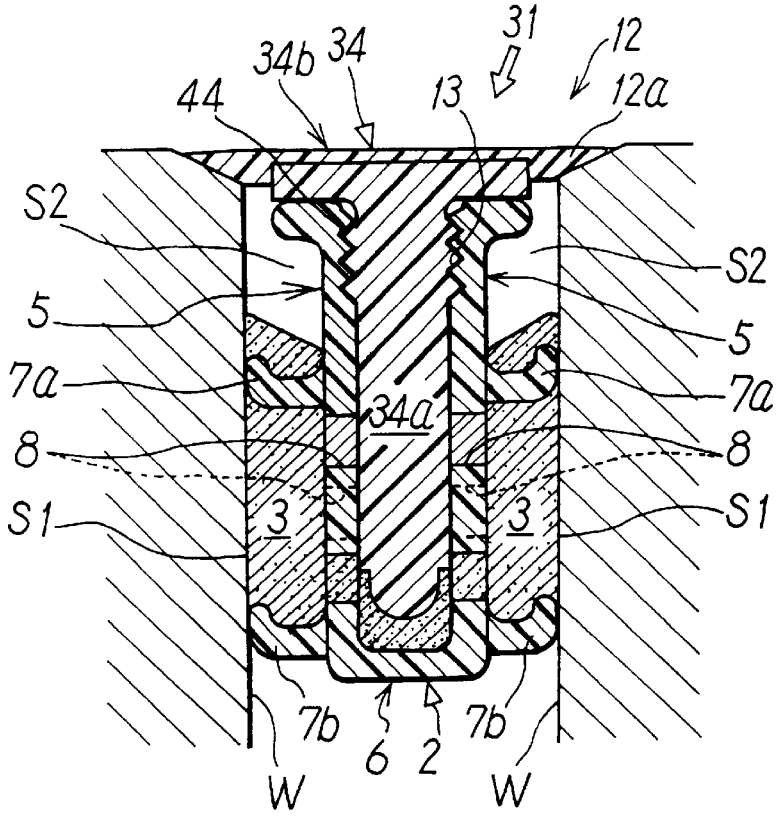
FIG. 5 is a sectional view illustrating the state after assembly of the joint seal of the second embodiment of the present invention.

FIG. 5 shows the second embodiment of the present invention. A joint seal 31 of the second embodiment is similar to that of the first embodiment in basic configuration. However, the sectional shape at the tip of a core portion 34*a* in heart wood 34 is formed in a rough mountain shape connecting with a smooth curved face, in order to facilitate insertion of heart wood 34 between side plates 5, 5 and distribution of the sealing material 3, and core portion 34*a* is formed with a certain length of which the core portion does not reach bottom plate 6 of joint base material 2. Thus, sealing material 3 pressed out in the left and right spaces is coupled between the tip part of the core portion 34*a* in this heart wood 34 and bottom plate 6 of the joint base material 2, ensuring a secure seal. The structure of heart wood head part 34*b* and the structure of engagement portion 44 to be formed at the base end part on both side faces of the core portion 34*a* are similar to those of the first embodiment.

Other configuration details, effects and assembly methods for the second embodiment are largely identical to the foregoing first embodiment. The same reference numerals are given to the same or corresponding portions, and a description is omitted.

Figure 6:
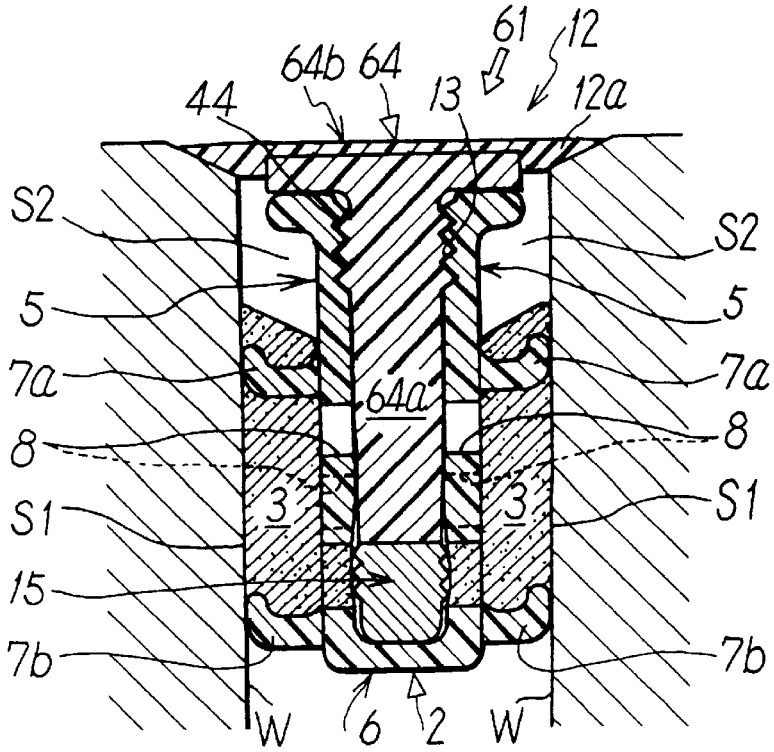
FIG. 6 is a sectional view illustrating the state after assembly of the joint seal of the third embodiment of the present invention.
Figure 7:
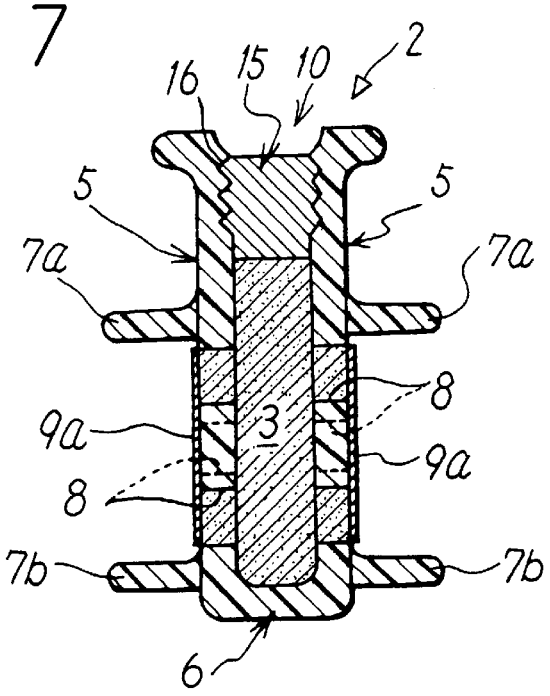
FIG. 7 is a sectional view illustrating the state in which the joint base material of the same embodiment as above is filled with a sealing material.

FIGS. 6 and 7 show the third embodiment of the present invention. A joint seal 61 of the third embodiment inserts and engages a cap body 15 into opening port 10 between both side plates 5, 5 in joint base material 2, into which sealing material 3 has been forced. Other configuration details are largely identical to that of the foregoing first embodiment.

Heart wood 64 to be pressed in between side plates 5, 5 in the foregoing joint base material 2 is molded in a sectional rough T shape similar to that in the foregoing first embodiment, as shown in FIG. 6, and a core portion 64a is formed with a certain length of which the tip of a cap body 15 just reaches bottom plate 6 of joint base material 2 when cap body 15 is pressed in while it is pushed.

The foregoing cap body 15 is maintained in the opening port 10 of both side plates 5, 5 in the foregoing joint base material 2 by mutually engaging an engagement portion 16 formed on both side faces and an engagement portion 13 formed at the opening edge on the inner face of both side plates 5, 5 as shown in FIG. 7. The foregoing sealing material 3 is prevented from flowing out from the opening portion between side plates 5, 5 in the joint base material 2 by means of this cap body 15. At the same time that joint base material 2 is pushed into the joint groove, side plates 5, 5 are pushed inward by means of the resistance force produced when the seal tongue pieces 7*a* and 7*b* projecting from the outer face of side plate 5 come into frictional contact with inner wall W of the joint groove, whereby opening port 10 between side plates 5, 5 narrows to prevent the sealing material from flowing out and heart wood 64 from being inserted.

Inserting and engaging such a cap body 15 into opening port 10 of joint base material 2 is effective, for example, when joint base material 2 is molded of a relatively soft material, depending on the material quality of the joint base material 2, the material quality of the sealing material 3, and so on.

A recess and a projection for mutually engaging the tip of core portion 64*a* of heart wood 64 and the upper end face of cap body 15 may be provided to facilitate insertion of the cap body 15 by means of the foregoing heart wood 64.

When joint seal 61 of the third embodiment is assembled, joint base material 2 is engaged in the joint groove in a way similar to that of the foregoing first embodiment, and heart wood 64 is pressed in while cap body 15 engaged in opening port 10 of joint base material 2 is pushed. Together with insertion of this heart wood 64, sealing material 3 is pressed out from a number of small openings 8 punched on side plates 5, 5 of joint base material 2.

Joint seal 61 of the third embodiment having the foregoing configuration ensures against side plates 5, 5 in joint base material 2 being forced together, and the resultant outflow of sealing material 3 when joint base material 2 is engaged in the joint groove by inserting and engaging cap body 15 into opening port 10 of joint base material 2.

Other configuration details, effects and assembly methods for the third embodiment are largely identical to those of the foregoing first embodiment. The same reference numerals are given to the same or corresponding portions, and descriptions are omitted.

Figure 8:
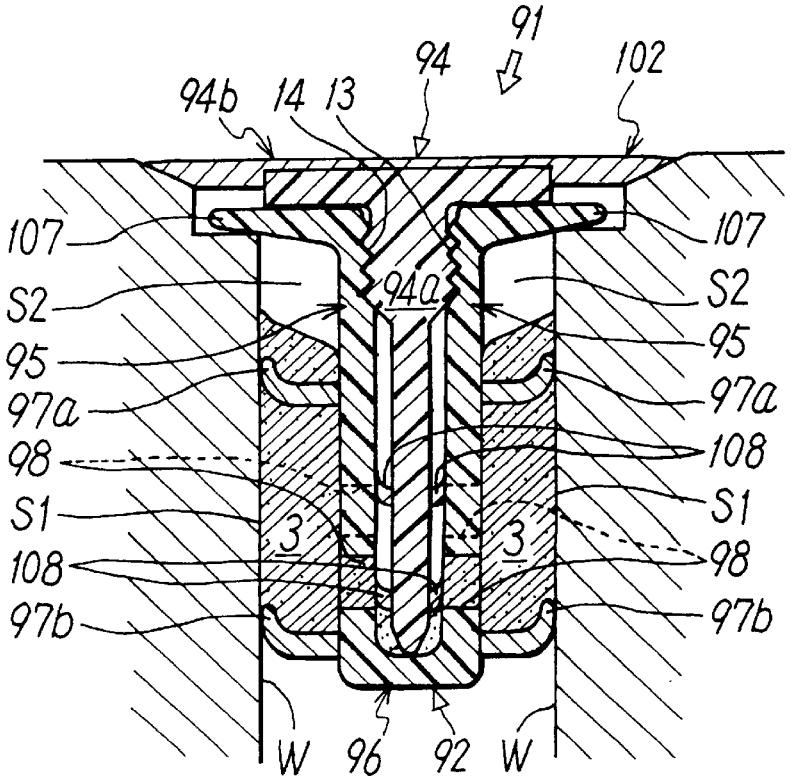
FIG. 8 is a sectional view illustrating the state after assembly of the joint seal of the fourth embodiment of the present invention.
Figure 9:
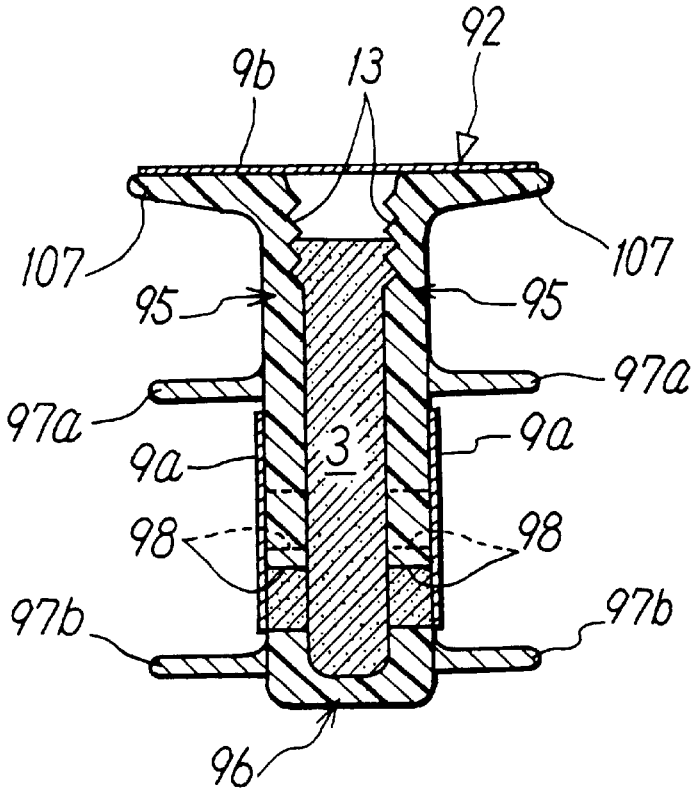
FIG. 9 is a sectional view illustrating the state in which the joint base material of the same embodiment as above is filled with a sealing material.
Figure 10:
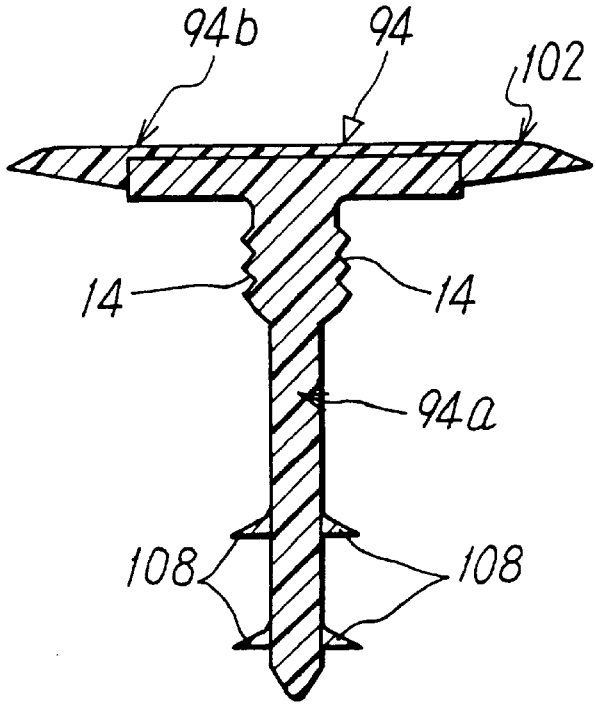
FIG. 10 is a sectional view of the heart wood in the joint seal of the fourth embodiment.

FIG. 8 to 10 illustrate the fourth embodiment of the joint seal of the present invention.

A joint seal 91 of the fourth embodiment is integrally provided with engaging and locking collar portions 107, 107, made of synthetic resin to lock with the opening edge of the joint groove at the upper ends of left and right side plates 95, 95 in joint base material 92.

A heart wood 94 with an exterior plate 102 of head part 94*b*, similar to that in the foregoing first embodiment as shown in FIGS. 8 to 10, is made thinner than in the first embodiment, to a length core portion 94a reaches bottom plate 96 of joint base material 92. This change facilitates insertion between side plates 95, 95; and collar portions 108, 108, made of soft synthetic resin for pressing out sealing material 3, are integrally molded at some, including a position close to the tip of both side faces of core portion 94*a*.

The other main configuration of the fourth embodiment is largely identical to the foregoing first embodiment. However, in this fourth embodiment, sealing material 3 is pressed through the small openings 98, 98, provided on side plates 95, 95 of joint base material 92, by heart wood 94, and flows back between side plates 95, 95 after collar portion 108 passes through a portion of small opening 98. Sealing material 3 prevents seepage of rainwater through the surface of heart wood 94 in the event of damage to bottom plate 96 of joint base material 92.

Since the foregoing engaging and locking collar portion 107 locks with the opening edge of the joint groove, seal tongue pieces 97*a* and 97*b* do not need to be formed to provide sufficient frictional force between side walls W in the joint groove.

In constructing joint material 91 of the fourth embodiment of the foregoing configuration, if joint base material 92 that peels off release mold sheet 9*a* on both side faces is engaged in the joint groove opening port, the engaging and locking collar portions 107, 107 provided at the upper ends of side plates 95, 95 of joint base material 92 lock with the opening edge of the joint groove, and seal tongue pieces 97*a* and 97*b* come into frictional contact with inner wall W of the joint groove, with the result that positioning and maintaining the position of the foregoing joint base material 92 can be made more reliable, regardless of the joint groove depth.

When heart wood 94 is pressed between side plates 95, 95 in joint base material 92, the foregoing engaging and locking collar portions 107, 107 are pushed and widened and are rigidly locked with the opening edge of the joint groove, and the foregoing seal tongue pieces 97*a* and 97*b* are pushed and widened and pressure-welded to inner walls W of the joint groove. The effect is to prevent joint base material 92 from being pushed into the joint groove, by pressing in heart wood 94.

Since collar portions 108, 108 are formed at some points, including a position close to the tip of both side faces of the foregoing thin heart wood 94, heart wood 94 is easily pressed in between side plates 95, 95, with the effect that sealing material 3 can be pressed out more reliably.

The frictional force of the foregoing collar portion 108 against the inner face of side plates 95, 95 in the foregoing joint base material 92 is rendered less than that of seal tongue pieces 97*a* and 97*b* of the foregoing joint base material 54, with the result that joint base material 92 is prevented from being pushed into the joint groove by pressing heart wood 94 in joint base material 92.

Other configuration details, effects, and assembly methods for joint seal 91 of the fourth embodiment closely resemble those of the foregoing first embodiment. Thus, corresponding portions retain the same reference numerals. We omit further description.

Figure 11:
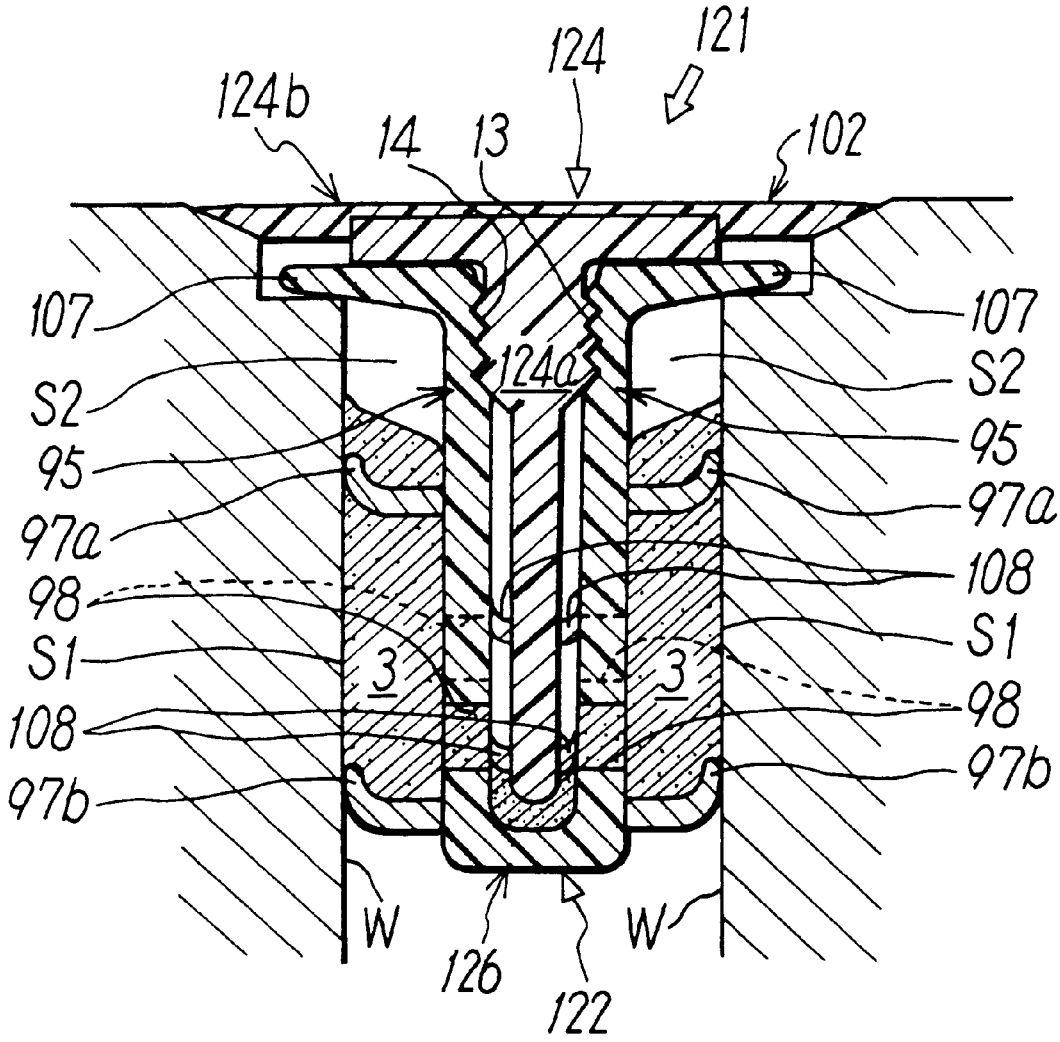
FIG. 11 is a sectional view illustrating the state after assembly of the joint seal of the fifth embodiment of the present invention.

FIG. 11 shows the fifth embodiment of the present invention. Although joint seal 121 of the fifth embodiment is identical in basic configuration to that of the foregoing fourth embodiment, a core portion 124*a* of the foregoing heart wood 124 is formed of a certain length, such that its tip does not reach bottom plate 126 of joint base material 122, whereby the sealing material 3 pressed out in the left and right spaces is coupled between the tip of core portion 124*a* in heart wood 124 and bottom plate 126 of the joint base material 122 to ensure a proper seal.

Other configuration details, effects, and assembly e methods for the fifth embodiment closely resemble those of the foregoing fourth embodiment. Thus, corresponding portions retain the same reference numerals. We omit further description.

Figure 12:
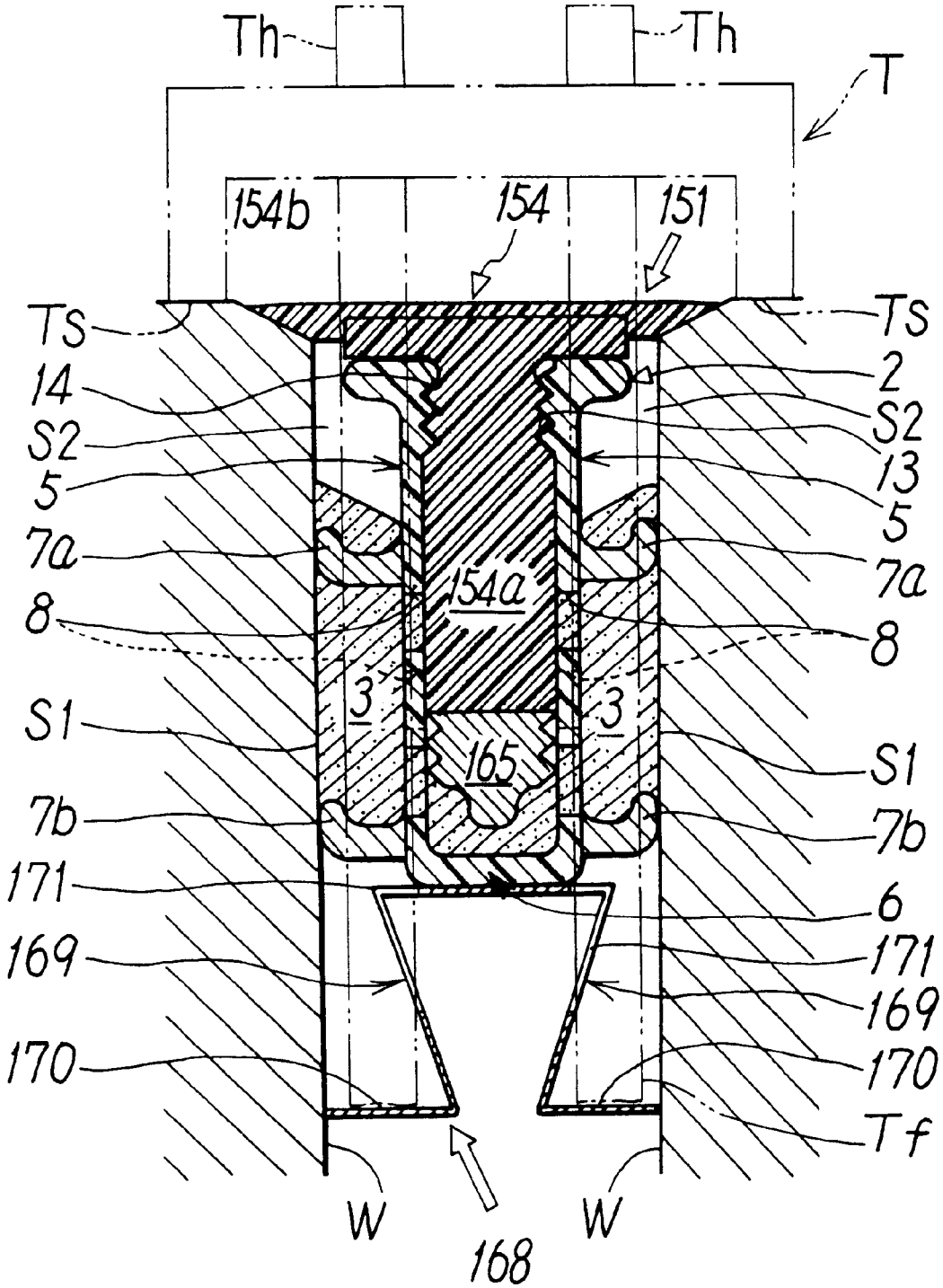
FIG. 12 is a sectional view illustrating the state after assembly of the joint seal of the sixth embodiment of the present invention.
Figure 13:
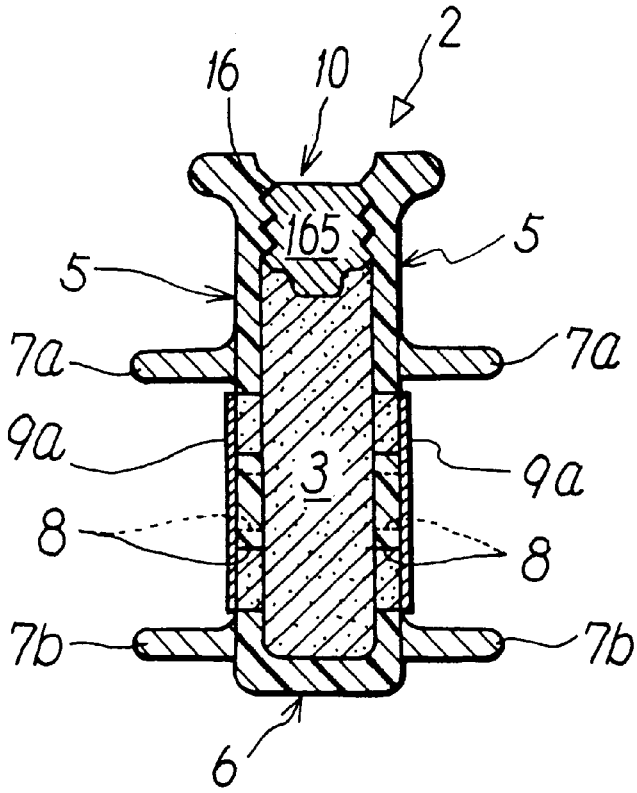
FIG. 13 is a sectional view illustrating the state in which the joint base material of the same embodiment as above is filled with a sealing material.

FIGS. 12 and 13 show the sixth embodiment of the present invention. Although joint seal 151 of the sixth embodiment is similar in basic configuration to the foregoing third embodiment, the tip cap body 165, which is to be inserted into and engaged with opening port 10 between side plates 5,5 in joint base material 2, into which sealing material is forced, is formed in a shape resembling a mountain outline connected to a smooth curve, in order to facilitate insertion between side plates 5, 5 of heart wood 154, or dispersion of sealing material 3 if cap body 165 is pressed in by heart wood 154 while cap body 165 is pushed.

When the foregoing joint base material 2 is pushed into the joint groove, a stopper 168 that sets the engagement depth of joint base material 2 is engaged in and maintained in the joint groove in advance, then maintained in the joint groove opening port by pushing joint base material 2 into the joint groove to the limit of the position at which bottom plate 6 of the foregoing joint base material 2 abuts stopper 168.

Heart wood 154, which is to be pressed in between side plates 5, 5 in foregoing joint base material 2, is sectionally molded roughly in the shape of the letter T, as in the foregoing third embodiment. As shown in FIG. 12, core portion 154*a* has a length such that the tip of cap body 165 does not reach bottom plate 6 of joint base material 2 when cap body 165 is pressed in while cap body 165 is pushed. Pressed out in both the left and right spaces, sealing material 3 is coupled between the tip of cap body 165 and bottom plate 6 of the joint base material 2 to ensure a reliable seal.

Figure 14:
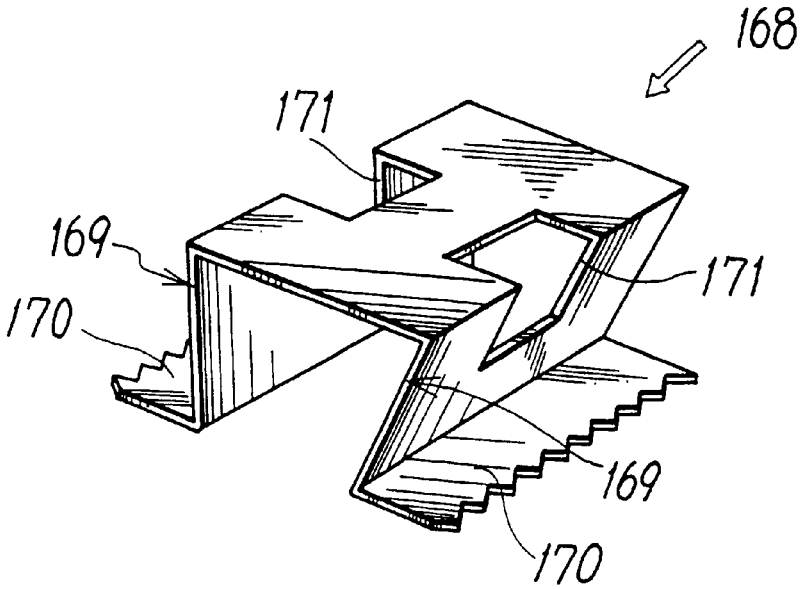
FIG. 14 is a perspective view illustrating an example of the stopper in the same embodiment as above.

The foregoing stopper 168, provided for setting the engagement depth of foregoing joint base material 2, is bent and molded roughly in the shape of the letter U by a metal plate spring that has properties clearly illustrated in FIGS. 12 and 14. A collar-shaped engaging and locking portion 170 that has a tooth-like projection for engaging and securing it to inner wall W of the joint groove is bent and molded at the tip of the left and right side face plates 169, 169. The left and right plates 169 of this stopper 168 have sufficient spring tension to engage the tip of the foregoing engaging and locking portion 170 to inner wall W of the joint groove.

When a joint seal 151 of the sixth embodiment of the foregoing configuration is constructed, stopper 168 is first engaged discretely in the joint groove and positioned there. This stopper 168 is engaged in the joint groove with a tool T that engages it to a certain depth in the groove, the surface of the building exterior material being made as a reference. The tool T, as indicated by chain line in FIG. 12, is used so that:

- both side plates 169, 169 are pressed together by a pair of pincers Tf through cutout portion 171 in stopper 168 in FIG. 14;
- stopper 168 is inserted into the joint groove with tool T until an abutting portion Ts, which serves to restricts the insertion position, abuts the surface of the exterior material, at which position stopper 168 is released by operation of the pincer Th, to engage and lock portion 170 to joint groove inner wall W;
- and whereby stopper 168 can be inserted and positioned at a specified distance.

Stopper 168 and tool T are shown as examples. Another stopper and tool that permits engaging and locking in the joint groove may be used.

Since the engagement depth of joint base material 2 is set by stopper 168, discretely positioned in the joint groove, joint base material 2 is never pushed too far into the joint groove, even when frictional contact is incomplete between seal tongue pieces 7*a* and 7*b*, projecting from the outer face of side plates 5, 5, and the joint groove inner wall W.

When seal tongue pieces 7*a* and 7*b*, which project from the outer face of side plates 5, 5 in the joint base material 2, are strong enough to keep the sealing material in the joint groove relying only on frictional contact with these seal tongue pieces and the joint groove inner wall W, joint base material 2 is inserted into joint groove opening port and engaged at a proper position at the limit of the position abutting stopper 168.

In this case, joint base material 2 may be inserted until bottom plate 6 is engaged at the point of abutting stopper 168. However, bottom plate 6 may be inserted and engaged at a proper position that falls short of stopper 168. In the configuration described above, the foregoing base material 2 is easily positioned, without regard to joint groove depth, and that position is easily maintained.

When heart wood 154 is pressed in, even if joint base material 2 has not yet been inserted and engaged in the position described above, joint base material 2 can be pressed in to a proper position with heart wood 154. In this case, joint base material 2 is never pressed in too far, due to the presence of stopper 168. In addition, when heart wood 154 is formed so that the tip of its core portion 154*a* does not quite reach bottom plate 6 of joint base material 2, the tip cannot be pressure-welded to bottom plate 6 of joint base material 2 when the heart wood 154 is pressed in. Thus, pressure is always transmitted via sealing material 3, avoiding damage to joint base material 2 and the resultant partial sealing failures.

In order to insert and engage the surface of head part 154*b* of heart wood 154 into the joint groove at a certain depth, that insertion depth may be adjusted while pressing in heart wood 154. In this case, if the insertion depth of the joint base material 2 is shallow, side plate 5 of joint base material 2 is pressed in together with joint base material 2 by heart wood 154, while the plate is pushed. The depth (height) of the surface of head part 154*b* of the heart wood 154 is easily adjusted in the joint groove.

Other configuration details, effects, and assembly methods of the joint seal 151 in the sixth embodiment closely resemble those of the foregoing third embodiment. Thus, corresponding portions retain the same reference numerals. We omit further description.

Figure 15:
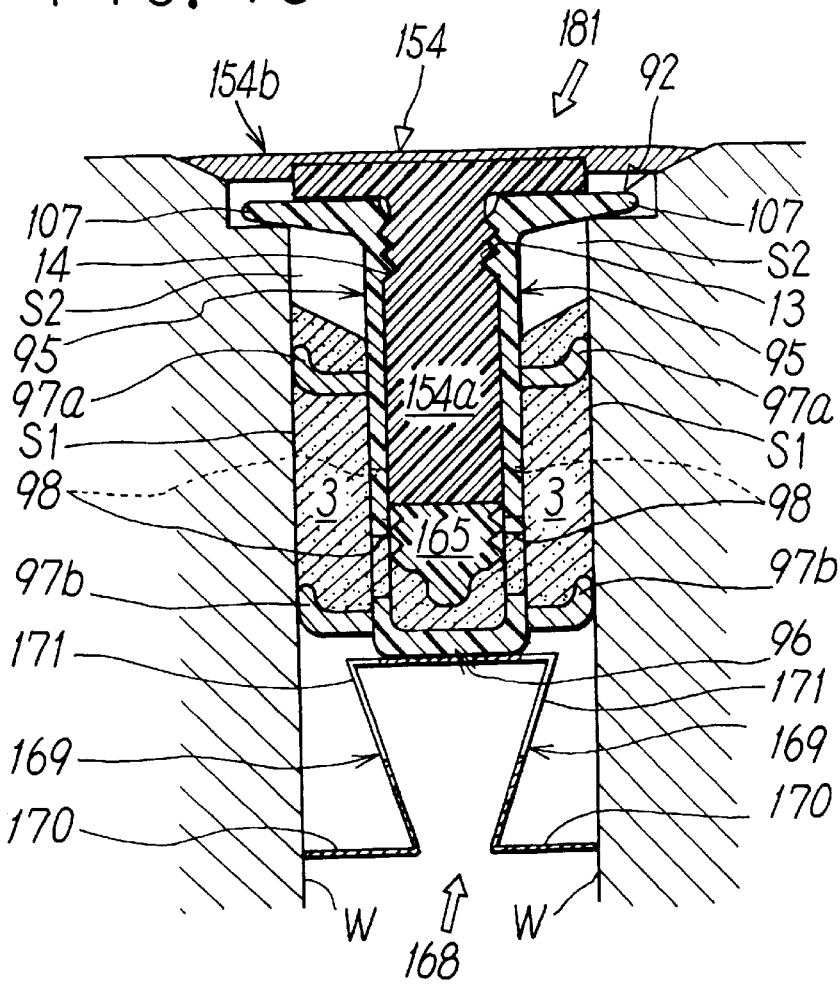
FIG. 15 is a sectional view illustrating the state after assembly of the joint seal of the seventh embodiment of the present invention.
Figure 16:
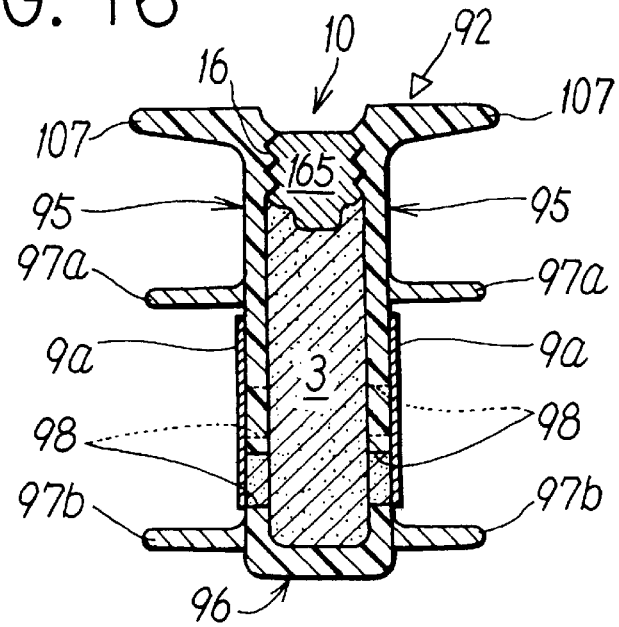
FIG. 16 is a sectional view illustrating the state in which the joint base material of the same embodiment as above is filled with a sealing material.

FIGS. 15 and 16 illustrate the seventh embodiment of the present invention.

In the seventh embodiment, the main configuration of joint seal 181 is identical to that of the foregoing sixth embodiment, except that engagement collar portions 107, 107, similar to those of the foregoing fourth embodiment, are integrally provided at the upper end of the left and right side plates 95, 95 in joint base material 92.

When joint seal 181 of the seventh embodiment of the foregoing configuration is constructed, a number of stoppers 168 is first positioned in the joint groove, then joint base material 92 is engaged in the joint groove opening port. The engaging and locking collar portions 107, 107 provided at the upper end of side plates 95, 95 of joint base material 92 are engaged and locked with the opening edge of the joint groove, and seal tongue pieces 97*a* and 97*b* come into frictional contact with joint groove inner wall W. Thus, positioning of the foregoing joint base material 92 and maintaining that position are made more reliable, regardless of the depth of the joint groove. Stopper 168 prevents excessive insertion when the opening edge portion of the joint groove is partially damaged or when excessive attempts are made to push in the joint base material.

Since the foregoing engaging and locking collar portion 107 is engaged and locked with the opening edge of the joint groove, seal tongue pieces 97*a* and 97*b* do not need to be formed to provide frictional force between the joint groove inner wall W and themselves.

Other configuration details, effects, and assembly methods regarding joint base material 92 in joint seal 181 in the seventh embodiment closely resemble those of the foregoing fourth embodiment and those of the sixth embodiment, except joint base material 92. Thus, corresponding portions retain the same reference numerals. We omit further description.

For joint seals in the first, second, fourth and fifth embodiments, when the joint base material is engaged in the joint groove opening portion as described above, the seal tongue pieces projecting from the outer wall of the side plate are pressure-welded to the inner wall of the joint groove. However, the sealing material is sometimes pressed out by a narrowing of an interval of the joint groove that is subject to resistance force from the inner wall of the joint groove. Such a problem can be resolved by improving the strength of the joint base material. As described in the foregoing third, sixth and seventh embodiments, sealing material can be prevented from flowing out from the opening port between the foregoing side plates prior to assembly of the joint seal by inserting and engaging the cap body at the opening port between side plates in the joint base material. At the same time, when the joint base material is engaged in the joint groove, the foregoing side plates are pushed in by the resistance force produced when the seal tongue pieces of the side plates come into frictional contact with the joint groove, narrowing the opening port of side plate, preventing the outflow of sealing material and the interference from pressing in of the foregoing heart wood.

As shown in the foregoing embodiments, the joint seal described in the present invention is not limited to use at the joint groove at the joint section between exterior materials. It can be applied to joint grooves at a variety of sites, exterior or interior.

What is claimed is:

1. A joint seal comprising:

a generally U-shaped joint base having side plates with at least one opening;

a plurality of seal tongue pieces projecting from said side plates to contact a wall of a groove into which the joint base is inserted;

a flowable sealing material occupying a space between said side plates;

a heart piece fittable in the joint base to displace the flowable sealing material through the at least one opening and into a space defined between said seal tongue pieces and the wall of the groove into which the joint base is inserted;

an exterior head plate for covering an opening of the groove into which the joint base is inserted; and a sealing member for preventing an outflow of the flowable sealing material from the space between said side plates.

2. The joint seal of claim 1, wherein the flowable sealing material is in a sufficient amount to form a seal between the joint base and the wall of the groove into which the joint base is inserted.

3. The joint seal of claim 1, wherein the sealing member comprises a release mold sheet covering the at least one opening of the side plates of the joint base.

4. The joint seal of claim 1, wherein the sealing member comprises a release mold sheet covering an opening port of the joint base.

5. The joint seal of claim 1, wherein the sealing member comprises a cap body that maintains the shape of the joint base.

6. A joint seal comprising:

a generally U-shaped joint base having side plates with at least one opening, and an engaging and locking collar portion;

a plurality of seal tongue pieces projecting from said side plates to contact a wall of a groove into which the joint base is inserted;

a flowable sealing material occupying a space between said side plates;

a heart piece fittable in the joint base to displace the flowable sealing material through the at least one opening and into a space defined between said seal tongue pieces and the wall of the groove into which the joint base is inserted;

an exterior head plate for covering an opening of the groove into which the joint base is inserted; and a sealing member for preventing an outflow of the flowable sealing material from the space between said side plates.

7. The joint seal of claim 6, wherein the flowable sealing material is in a sufficient amount to form a seal between the joint base and the wall of the groove into which the joint base is inserted.

8. The joint seal of claim 6, wherein the sealing member comprises a release mold sheet covering the at least one opening of the side plates of the joint base.

9. The joint seal of claim 6, wherein the sealing member comprises a release mold sheet covering an opening port of the joint base.

10. The joint seal of claim 6, wherein the sealing member comprises a cap body that maintains the shape of the joint base.

11. The joint seal of claim 1, wherein the heart piece includes collar portions engageable with the side plates for pressing out the flowable sealing material.

12. The joint seal of claim 6, wherein the heart piece includes collar portions engageable with the side plates for pressing out the flowable sealing material.

13. The joint seal of claim 1, further comprising a cap body engageable with the side plates.

14. The joint seal of claim 6, further comprising a cap body engageable with the side plates.

15. A method for sealing a joint, comprising the steps of:

inserting into a groove of the joint a generally U-shaped joint base having side plates with at least one opening, a plurality of seal tongue pieces projecting from said side plates to contact a wall of a groove into which the joint base is inserted, and a flowable sealing material occupying a space between said side plates;

removing at least one sealing member preventing an outflow of the flowable sealing material from the space between said side plates; and pressing a heart piece in the joint base to displace the flowable sealing material through the at least one opening and into a space defined between said seal tongue pieces and the wall of the groove into which the joint base is inserted.

16. The method of claim 15, wherein the displaced flowable sealing material forms a seal between the joint base and the wall of the groove into which the joint base is inserted.

17. A method for sealing ajoint, comprising the steps of:

inserting into a groove of the joint a generally U-shaped joint base having side plates with at least one opening, a plurality of seal tongue pieces projecting from said side plates to contact a wall of a groove into which the joint base is inserted, a flowable sealing material occupying a space between said side plates, and a cap body that seals a port opening of said space and maintains the shape of the joint base; and pressing a heart piece in the joint base to displace the cap body and displace the flowable sealing material through the at least one opening and into a space defined between said seal tongue pieces and the wall of the groove into which the joint base is inserted.

18. A method for sealing a joint, comprising the steps of:

inserting into a groove of the joint a generally U-shaped joint base having side plates with at least one opening, an engaging and locking collar portion, a plurality of seal tongue pieces projecting from said side plates to contact a wall of a groove into which the joint base is inserted, and a flowable sealing material occupying a space between said side plates;

removing at least one sealing member preventing an outflow of the flowable sealing material from the space between said side plates; and pressing a heart piece in the joint base to displace the flowable sealing material through the at least one opening and into a space defined between said seal tongue pieces and the wall of the groove into which the joint base is inserted.

* * * * *